United States Patent [19]

Vishnevsky et al.

[11] Patent Number: 4,609,029

[45] Date of Patent: Sep. 2, 1986

[54] METHOD OF REDUCING CASTING TIME

[75] Inventors: Constantine Vishnevsky, Solon; Thomas A. Kolakowski, Moreland Hills, both of Ohio

[73] Assignee: TRW Inc., Cleveland, Ohio

[21] Appl. No.: 792,632

[22] Filed: Oct. 28, 1985

Related U.S. Application Data

[63] Continuation of Ser. No. 239,143, Feb. 27, 1981, abandoned.

[51] Int. Cl.[4] ..... B22D 27/04

[52] U.S. Cl. ..... 164/122; 164/127

[58] Field of Search ..... 164/122.1, 128, 126, 164/127, 122.2

[56] References Cited

U.S. PATENT DOCUMENTS 3,532,155 10/1970 Kane et al. ..... 164/122.1
3,915,761 10/1975 Tschinkel et al. ..... 164/127 X
4,190,094 2/1980 Giamei ..... 164/125

*Primary Examiner*—Kuang Y. Lin
*Attorney, Agent, or Firm*—Yount & Tarolli

[57] ABSTRACT

An improved method of casting an article decreases the time required to cast the article without affecting the quality of the article. When a directionally solidified (DS) casting is made, molten metal is poured into a mold cavity. One end of the mold cavity is exposed to a chill plate which initiates solidification of the molten metal. As the metal solidifies, a dendritic structure grows upwardly into the mold cavity. Molten metal is disposed in the interstices of the uppermost portions of dendritic structure. As the metal in the mold cavity cools, the molten metal in the interstices solidifies and the dendritic structure, including a region containing some molten metal in the interstices, continues to grow upwardly toward the upper end of the mold cavity. The directional solidification of the metal in the mold cavity is promoted by slowly withdrawing the mold from a furnace as the molten metal solidifies. In accordance with the present invention, when the upper end of the dendritic structure reaches the upper end of the mold cavity, the rate of withdrawal of the mold from the furnace is substantially increased to accelerate the solidification of the remaining molten metal.

5 Claims, 5 Drawing Figures

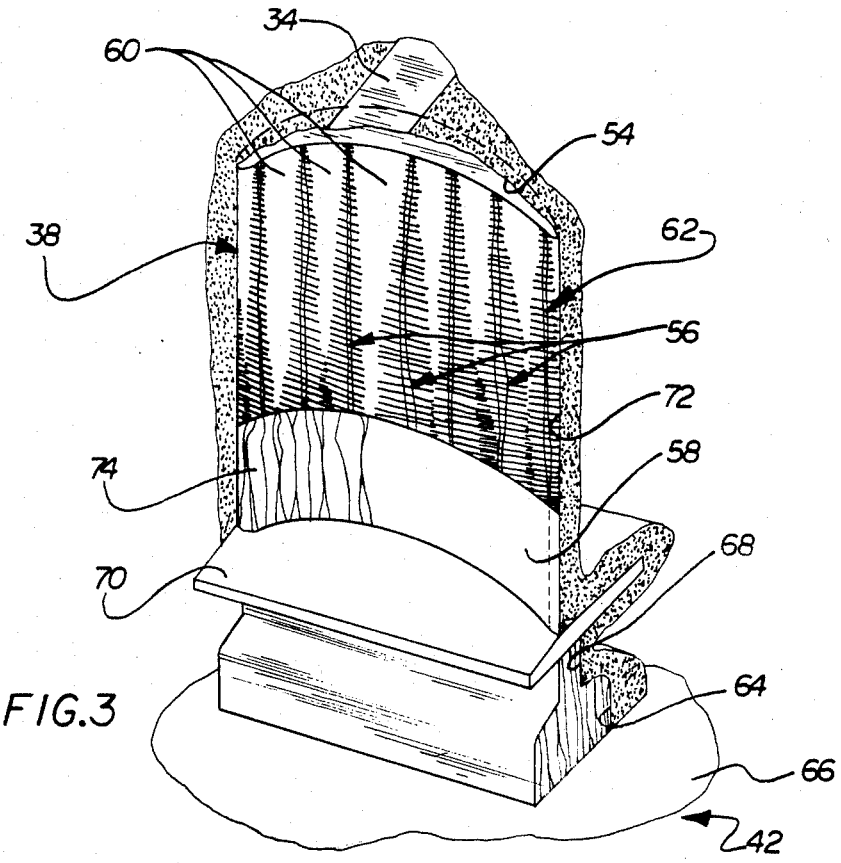
FIG.3
FIG.4
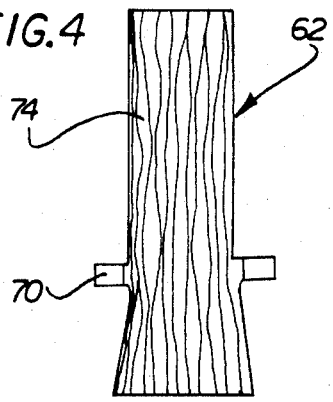
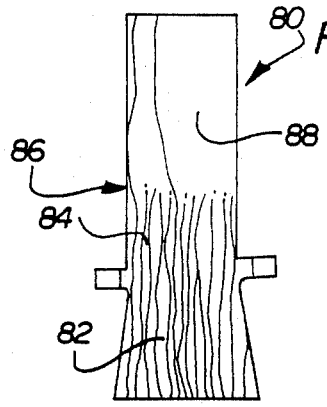
FIG.5

METHOD OF REDUCING CASTING TIME

This is a continuation of co-pending application Ser. No. 239,143, filed on Feb. 27, 1981 now abandoned.

BACKGROUND OF THE INVENTION

The present invention relates to a method of making directionally solidified (DS) castings and more specifically to a method which reduces the time required to cast a directionally solidified article without reducing the quality of the cast product.

In casting directionally solidified articles from nickel-base superalloys, a mold is commonly positioned on a chill plate which is slowly withdrawn from a furnace to provide for controlled solidification of molten metal in the mold in a manner similar to that disclosed in U.S. Pat. Nos. 3,700,023 and 3,714,977. During various DS casting operations, it has been observed that the mold can be withdrawn from the furnace at speeds of up to about 20 in./hr. to generate acceptable columnar grain structures. The specific speeds at which a particular article is withdrawn from the furnace are governed by the geometry of the article. If it is attempted to use higher speeds, such as 30 in./hr., it has previously been determined that a substantial and very objectionable coarsening of the columnar grains occurs. Attempts to change the temperatures and temperature distribution in the furnace hot zone have proven to be ineffective in permitting the use of faster withdrawal speeds for the production of gas turbine articles such as blades and vanes.

In an effort to increase withdrawal speeds to a rate of 25 in./hr. or faster, U.S. Pat. No. 3,532,155 discloses an apparatus in which the mold and cooling plate are moved through a heat sink which is disposed immediately beneath the furnace. As a still further effort to reduce the time required to form a casting, U.S. Pat. No. 4,190,094 suggests varying the rate of withdrawal of the mold from a furnace as a function of the geometry of the article to be cast and other factors.

SUMMARY OF THE PRESENT INVENTION

The present invention decreases the time required to form a directionally solidified (DS) casting without substantial coarsening of the columnar grains of the casting. This is accomplished by initially withdrawing a mold from a furnace at relatively slow speeds. As the mold is slowly withdrawn from the furnace, a dendritic structure grows upwardly toward the upper end of the mold cavity. The uppermost interstices of this dendritic structure are filled with molten metal. In the art this region of the casting in which a skeleton of solid dendrite and liquid metal coexist is called the mushy zone. When the dendritic structure reaches the upper end of the mold cavity, the rate of withdrawal of the mold from the furnace is increased to increase the rate of solidification of the molten metal in the interstices of the dendritic structure, that is, to complete solidification of the mushy zone.

Although it is contemplated that the present invention may be used to cast many different types of articles, the invention is advantageously used during the casting of airfoils having relatively thick bases and thin airfoils. During the solidification of the metal in the relatively thick base and a lower portion of the airfoil, the mold is slowly withdrawn from the furnace. However, as soon as the dendritic structure in the relatively thin airfoil reaches the upper end of the mold cavity, that is the tip of the airfoil, the rate of withdrawal of the mold from the furnace is increased to increase the speed of solidification of the molten metal remaining in the dendritic structure.

Accordingly, the present invention provides an improved method of casting an article by initially solidifying molten metal at a relatively slow rate and then increasing the rate of solidification of the molten metal after a dendritic structure has been extended to an upper end of the mold.

BRIEF DESCRIPTION OF THE DRAWINGS

The foregoing and other features and advantages of the present invention will become more apparent upon a consideration of the following description taken in conjunction with the accompanying drawings wherein:

FIG. 3 is an enlarged fragmentary schematic illustration depicting the relationship between a portion of the mold of FIG. 2, the solidified metal at a lower end of the mold cavity, and a schematically illustrated dendritic structure extending upwardly from the solidified metal to an upper end of the mold cavity;

FIG. 4 is a schematic illustration depicting the columnar grain appearance of a blade cast with the mold of FIG. 1 by withdrawing the mold from the furnace at a relatively slow speed until the dendritic structure extends to the upper end of the mold cavity as shown in FIG. 3 and then rapidly withdrawing the mold from the furnace; and FIG. 5 is a schematic illustration, generally similar to FIG. 4, of the columnar grain appearance of an airfoil formed by rapidly withdrawing a mold from a furnace.

DESCRIPTION OF ONE SPECIFIC PREFERRED EMBODIMENT OF THE INVENTION

Figure 1:
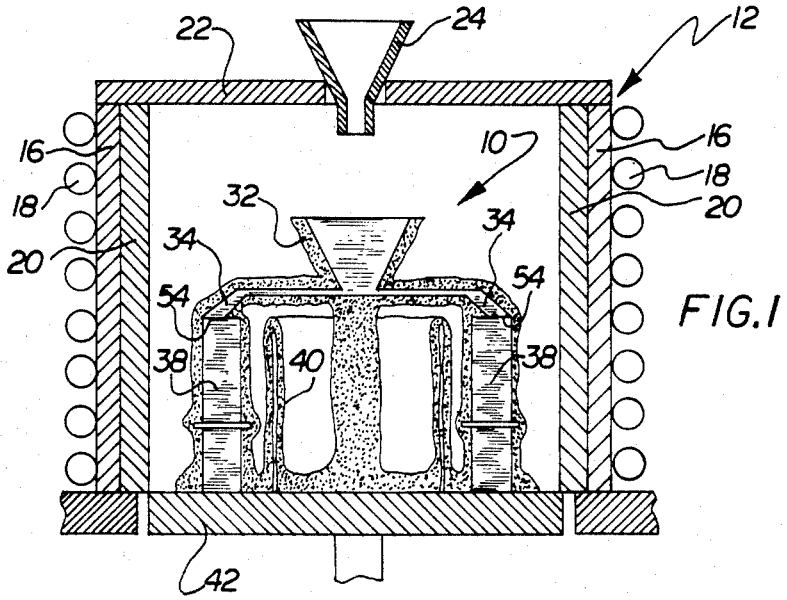
FIG. 1 is a schematic illustration depicting the relationship between a mold containing molten metal and a furnace immediately after pouring of the molten metal into the mold.

A mold 10 (FIG. 1) is preheated in a known furnace assembly 12 prior to pouring of molten metal into the mold. The known furnace assembly 12 is provided with a refractory outer wall 16 which is surrounded by an induction heating coil 18. A graphite susceptor wall 20 is enclosed by the outer wall 16 and is heated by the induction effect of the coil 18. The furnace assembly 12 has a top plate 22 with an opening which may be provided with a funnel 24 through which molten metal is poured into the mold 10. It is contemplated that the entire furnace assembly 12 will be disposed within a vacuum.

The mold 10 has a pouring basin 32 through which molten metal enters a plurality of runners or passages 34 which are connected with a plurality of mold cavities 38 which are disposed in a circular array around the pouring basin 32. A cylindrical heat shield 40 may be provided on the inside of the circular array of mold cavities 38.

The mold 10 is disposed on a copper chill plate 42. The chill plate 42 promotes the directional solidification of molten metal in the mold cavities to provide a casting having a columnar grain structure with a grain orientation extending generally parallel to the longitudinal central axes (vertical axes) of the mold cavities 38. The furnace 12 is of a known construction and may be constructed in accordance with U.S. Pat. Nos. 3,376,915; 3,700,023 and/or 3,714,977.

When molten metal is poured into the basin 22 and the runners 34 to mold cavity 38, the molten metal flows downwardly and solidifies against the chill plate 42. A large number of randomly oriented crystals are nucleated at the chill plate. As this is occurring, a dendritic structure starts to extend upwardly from the metal which is solidified against the chill plate into a competitive growth zone. The chill plate is then slowly lowered from the furnace. As the chill plate is lowered, the most favorably oriented grains or crystals emerge from the competitive growth zone and the dendritic structure continues to grow upwardly into the mold cavity 38. Although it is contemplated that the chill plate could be lowered at many different rates, relatively slow initial lowering rates below about 20 in./hr. are presently preferred. It is contemplated that for some parts it will be preferred to maintain the relatively slow initial withdrawal rate substantially constant. However, for other parts, it may be preferred to vary the initial withdrawal somewhat between speeds which are less than about 20 in./hr.

In accordance with a feature of the present invention, once the dendritic structure has reached the upper end 54 of the mold cavity 38, the rate of withdrawal of the mold is substantially increased. This results in relatively rapid solidification of the molten metal remaining in the interstices of the dendritic structure. However, since the basic dendritic structure has already been established throughout the length of the mold cavity, the rapid solidification of the molten metal that remains in the so-called mushy zone does not lead to coarsening of the grain structure.

Figure 2:
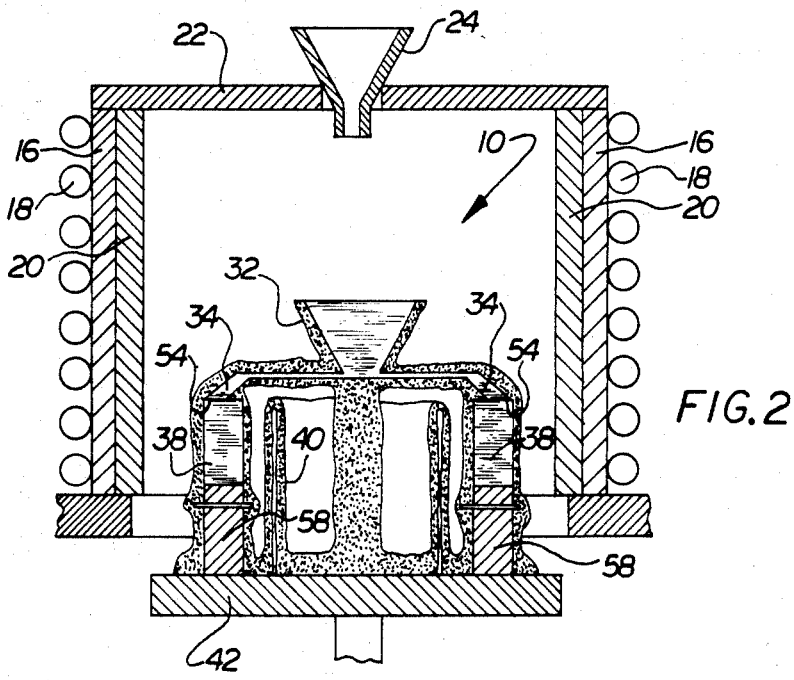
FIG. 2 is a schematic illustration depicting the relationship between the mold and the furnace after the mold has been partially withdrawn from the furnace at a relatively slow speed and the molten metal in the mold cavity has partially solidified.

In practicing the invention, the mold 10 is initially lowered from the position shown in FIG. 1 to the position shown in FIG. 2 at relatively slow speeds, that is speeds of approximately 20 in./hr. or less. Once the mold 10 has been moved to the partially withdrawn position shown in FIG. 2 and a dendritic structure 56 (FIG. 3) extends from a fully solidified body 58 of metal at the lower end portion of the mold cavity 38 to the upper end 54 of the mold cavity, the rate of downward movement of the chill plate is increased. The interstices of the uppermost portions of the dendritic structure, the so-called mushy zone, are filled with molten metal 60.

It is contemplated that the rate of downward movement of the chill plate will be increased by a substantial extent when the dendritic structure 56 reaches the top of the mold cavity. However, it is believed that the amount by which the rate of withdrawal can be increased will depend upon the article being cast and the specific alloy of which it is formed. However, in one specific instance, the rate of withdrawal of the mold was increased from a speed of less than 20 in./hr. to a speed of more than 34 in./hr. in casting a turbine blade formed of a nickel-base superalloy. Even though the rate of withdrawal of the mold 10 from the furnace assembly 12 was substantially increased, there was no objectionable coarsening of the grains of the cast article. It is believed that this is because the molten metal 60 in the interstices of the dendritic structure solidified without altering the basic dendritic structure which had been established throughout the molten metal in the mold cavity 38 prior to the increased rate of withdrawal of the mold 10 from the furnace assembly 12.

Although it is contemplated that the present invention can be used during the casting of many different articles, the present invention is advantageously used during the casting of a directionally solidified airfoil. Thus, each of the mold cavities 38 has a lower portion with a configuration corresponding to the configuration of a starter block and the base of the blade. Each of the mold cavities 38 also has a portion which extends upwardly from the base portion of the mold cavity and has a configuration corresponding to the configuration of the airfoil of the blade. The airfoil of the blade has a substantially uniform thickness throughout its axial extent.

A mold cavity 38 with a partially cast blade 62 is shown schematically in FIG. 3. The mold cavity 38 includes a lower end portion 64 which extends upwardly from an upper surface 66 of the chill plate 42. This lower end portion 64 of the mold cavity has a generally rectangular configuration. Directly above the lower end portion 64 of the mold cavity 38 is an intermediate portion 68 having a configuration corresponding to the configuration of the base 70 of the blade 62. An upper portion 72 of the mold cavity 38 extends upwardly from the intermediate portion 68 and has a configuration corresponding to the configuration of an airfoil portion 74 of the blade 62. The mold cavity terminates at the upper end surface 54 which is connected with a runner 34 through which molten metal enters the mold cavity 38.

When the blade 62 is to be cast in the mold cavity 38, molten metal enters the mold cavity through the runner 34. Molten metal flows downwardly through the mold cavity 38 into engagement with the upper surface 66 of the chill plate 42. The molten metal immediately soldifies in the lower end portion 64 of the mold cavity 38. The initially solidified molten metal has a random columnar grain structure next to the chill plate 42. However, the more favorably oriented grains grow rapidly upwardly from the chill plate 42 through a competitive growth zone from which the most favorably oriented grains emerge. These most favorably oriented grains enter the intermediate portion 68 of the mold cavity and solidify to initiate formation of a base portion 70 of the blade 62.

As the molten metal is solidifying, an upwardly extending dendritic structure 56 is formed. This dendritic structure consists of a plurality of most favorably oriented grains which form a plurality of upwardly extending dendrites. As the upward formation of the dendritic structure 56 continues, the molten metal in the interstices of the uppermost portions of dendritic structure solidifies to continue the formation of the base portion 70 of the blade 62.

As the upward growth of the dendritic structure 56 extends into the upper portion 72 of the mold cavity 38, the formation of the base portion 70 of the blade 62 is completed and continued solidification of the molten metal in the interstices of the dendritic structure initiates the formation of the airfoil 74. As the molten metal solidifies to form the lower end portion of the airfoil 74, the dendritic structure grows upwardly to the tip of the airfoil at the surface 54.

At this time, the base 70 of the airfoil has solidified and the lower portion of the airfoil 74 of the blade is solidified. However, the upper portion of the airfoil of the blade has not fully solidified. Thus, there is a basic dendritic structure 56 extending from the solidified lower portion of the airfoil 74 to the tip of the airfoil at the upper end surface 54 of the mold cavity 38. The interstices of the uppermost portions of the basic dendritic structure 56 are filled with molten metal 60. This uppermost portion, containing both solid dendrites and interstices filled with molten metal is known in the art as the mushy zone. The height of the mushy zone can be several inches, with the specific distance being related to the alloy being cast and how sharp the vertical temperature drop or thermal gradient is in the solidifying metal.

When the dendritic structure 56 has reached the upper end 54 of the mold cavity 38, the rate of withdrawal of the mold 10 from the furnace assembly 12 is substantially increased. Since the dendritic structure has been formed throughout the length of the airfoil 74 of the blade 62, there is no coarsening of the grains at the upper end portion or tip of the airfoil due to the increased speed of withdrawal of the mold 10 from the furnace 12. This is true even though the airfoil 74 has a substantially uniform thickness throughout its length.

The blade 62 which results from this casting process has been illustrated schematically in FIG. 4. The grains of the directionally solidified blade extend to the tip end of the airfoil without coarsening of the grains. By way of experimentation, a mold of the same general construction as the mold 10 was withdrawn at a constant relatively high speed from the furnace assembly 12. The resulting blade 80 (see FIG. 5) had a relatively fine grain structure adjacent to its base 82 and at the lower end portion 84 of the airfoil 86. However, the upper or airfoil tip portion 88 of the airfoil was very coarse grained and consisted of two or three crystals. The coarse grained outer end portion of the airfoil 86 of the blade 80 makes the casting unacceptable for use in most circumstances. However, the continuous fine grained structure of the blade 62 (FIG. 4) is quite acceptable for most purposes.

The fine grained structure of the blade 62 could have been obtained by withdrawing the mold from the furnace assembly 12 at a constant and relatively low speed. Thus, an airfoil with the same fine grained structure as has been illustrated schematically in FIG. 4 for the blade 62 could have been obtained by withdrawing the mold 10 from the furnace 12 at a relatively low speeds of approximately 20 in./hr or less. However, this results in a relatively long casting process.

The present invention substantially decreases the amount of time required to cast the fine grained blade 62 by increasing the rate of withdrawal of the mold 10 from the furnace 12 when the dendritic structure 56 has grown from the solidified body of metal 58 at the lower end portion of the mold 10 to the upper end surface 54 of the mold. Thus, in accordance with the present invention the mold 10 is initially withdrawn at a relatively slow speeds from the furnace 12, that is at a speeds of less than about 20 in./hr. Once the dendritic structure has extended throughout the molten metal in the mold cavity 38, the speed of withdrawal of the mold 10 from the furnace 12 is increased to, for example, a speed of 34 in./hr.

It should be understood that the specific mold withdrawal rates previously set forth have been for purposes of clarity of illustration and it is contemplated that these withdrawal rates may vary. The specific mold withdrawal rates of less than about 20 in./hr. before the dendritic structure extends throughout the molten metal in the mold cavity 34 and the relatively rapid mold withdrawal rate of 34 in./hr. after the dendritic structure has grown to the end surface 54 of the mold cavity were used with a nickel base superalloy, specifically PWA 1422 alloy, with a mold which was preheated to approximately 2700° F. The time saved during the process of casting one specific airfoil by using the previously described low and then high speed withdrawal after the dendrites had extended through the molten metal was approximately 26 minutes. Of course, the maximum rate of withdrawal and the time saved on a casting cycle will vary with the characteristics of the article being cast and the specific, relatively slow, speeds at which it is cast using conventional practice.

In view of the foregoing it is apparent that the present invention decreases the time required to form a directionally solidified (DS) casting without substantial coarsening of the columnar grains of the casting. This is accomplished by initially withdrawing a mold 10 from a furnace 12 at relatively slow speeds. As the mold 10 is slowly withdrawn from the furnace 12, a dendritic structure 56 grows upwardly toward the upper end 54 of the mold cavity 38. The interstices of this dendritic structure 56 are filled with molten metal. When the dendritic structure 56 reaches the upper end 54 of the mold cavity 38, the rate of withdrawal of the mold 10 from the furnace 12 is increased to increase the rate of solidification of the molten metal in the interstices of the dendritic structure 56.

Although it is contemplated that the present invention may be used to cast many different types of articles, the invention is advantageously used during the casting of blades 62 having relatively thick bases 70 and thin airfoils 74. During the solidification of the metal in the relatively thick base 70 and a lower portion of the airfoil 74, the mold 10 is slowly withdrawn from the furnace 12. However, as soon as the dendritic structure in the relatively thin airfoil 74 reaches the upper end 54 of the mold cavity, that is the tip of the airfoil, the rate of withdrawal of the mold 10 from the furnace 12 is increased to increase the speed of solidification of the molten metal in the dendritic structure.

Having described one specific preferred embodiment of the invention, the following is claimed.

1. A method of casting an article in a mold cavity, said method comprising the steps of heating at least a portion of a mold in a furnace, pouring molten metal into a cavity in the mold, withdrawing the mold from the furnace at a first rate after having performed said step of pouring molten metal into the mold cavity, solidifying the molten metal in the mold cavity while performing said step of withdrawing the mold from the furnace at the first rate, said step of solidifying the metal in the mold cavity including the steps of forming a dendritic structure having molten metal in its interstices, solidifying portions of the molten metal in the interstices and continuing the formation of the dendritic structure until the dendritic structure reaches an upper end of the mold cavity while performing said step of solidifying portions of the molten metal in the interstices, and increasing the rate of solidification of the molten metal in the interstices of the dendritic structure as soon as the dendritic structure reaches the upper end of the mold cavity, said step of increasing the rate of solidification of the molten metal includes the step of increasing the rate at which the mold is withdrawn from the furnace from the first rate to a second rate as soon as the dendritic structure reaches the upper end of the mold cavity.

2. A method as set forth in claim 1 further including the step of maintaining the rate at which the mold is withdrawn from the furnace substantially constant at the first rate until the dendritic structure reaches the upper end of the mold cavity.

3. A method as set forth in claim 1 wherein said second rate of withdrawal is greater than thirty inches per hour.

4. A method of casting a blade having a relatively thick base and a relatively thin airfoil, said method comprising the steps of heating in a furnace at least a portion of a mold having a cavity with a lower end portion having a configuration corresponding to the configuration of the relatively thick base of the blade and an upper end portion having a configuration corresponding to the configuration of the relatively thin airfoil of the blade, pouring molten metal into the mold cavity, withdrawing the mold from the furnace at a first rate after having performed said step of pouring molten metal into the mold cavity, solidifying the molten metal in the lower end portion of the mold cavity to form the relatively thick base of the blade while performing said step of withdrawing the mold from the furnace at the first rate, solidifying part of the molten metal above the lower end portion of the mold cavity to form a portion of the relatively thin airfoil of the blade while continuing to perform said step of withdrawing the mold from the furnace, said step of solidifying the molten metal to form a portion of the relatively thin airfoil including the step of extending a dendritic structure with molten metal in its interstices upwardly from the soldified metal forming part of the relatively thin airfoil while performing said step of withdrawing the mold from the furnace, increasing the rate at which the mold is withdrawn from the furnace to a second rate which is greater than the first rate as soon as the dendritic structure extends to the upper end of the mold cavity, and solidifying the molten metal in the interstices of the dendritic structure to complete the formation of the relatively thin airfoil while withdrawing the mold from the furnace at the second rate.

5. A method as set forth in claim 4 wherein said step of solidifying the molten metal to form a portion of the relatively thin airfoil includes the step of withdrawing the mold from the furnace at the first rate.

* * * * *